United States Patent [19]

Heller et al.

[11] Patent Number: 4,958,817

[45] Date of Patent: Sep. 25, 1990

[54] OPERATING TABLE

[75] Inventors: Rudolf Heller, Zürich; Alfred Michel, Dietlikon, both of Switzerland

[73] Assignee: Carl-Zeiss-Stiftung, Heidenheim, Fed. Rep. of Germany

[21] Appl. No.: 421,086

[22] Filed: Oct. 13, 1989

[30] Foreign Application Priority Data

Nov. 4, 1988 [CH] Switzerland ..... 04105/88

[51] Int. Cl.[5] ..... A61G 13/00

[52] U.S. Cl. ..... 269/323

[58] Field of Search ..... 269/322–328, 269/45, 71, 73; 378/91, 196, 208–209, 179; 254/134

[56] References Cited

U.S. PATENT DOCUMENTS

| | | | |
|---|---|---|---|
| 2,092,266 | 9/1937 | Talas . | |
| 2,416,410 | 2/1947 | Shampaine . | |
| 2,456,277 | 12/1948 | Heitz-Boyer . | |
| 2,501,415 | 3/1950 | Shampaine . | |
| 3,206,188 | 9/1965 | Douglass | 269/325 |
| 4,630,509 | 12/1986 | McLean | 269/71 |
| 4,653,083 | 3/1987 | Rossi | 378/209 |
| 4,842,259 | 6/1989 | Rice | 269/323 |

FOREIGN PATENT DOCUMENTS

| | | | |
|---|---|---|---|
| 468145 | 3/1972 | Australia | 378/179 |
| 0086881 | 8/1983 | European Pat. Off. . | |
| 268072 | 12/1912 | Fed. Rep. of Germany . | |
| 414151 | 5/1925 | Fed. Rep. of Germany . | |
| 522300 | 4/1931 | Fed. Rep. of Germany . | |
| 1054664 | 4/1959 | Fed. Rep. of Germany . | |
| 2204283 | 9/1972 | Fed. Rep. of Germany . | |
| 468354 | 7/1914 | France . | |
| 2157190 | 6/1973 | France . | |
| 42136 | 12/1907 | Switzerland . | |
| 66397 | 12/1912 | Switzerland . | |
| 165276 | 9/1964 | U.S.S.R. | 378/179 |
| 1347920 | 2/1974 | United Kingdom . | |

*Primary Examiner*—Robert C. Watson

*Attorney, Agent, or Firm*—Werner W. Kleeman

[57] ABSTRACT

An operating table comprises a patient rest or support structure which is mounted at a rolling bearing, i.e. a bearing associated with the rolling motion of the patient rest or support structure. The axis of this rolling bearing corresponds with a rolling or roll axis and defines a predetermined angle with the patient rest or support structure, so that the extension of the axis of the rolling bearing, subsequent to intersection thereof with the plane of the patient rest or support structure at a predetermined punctiform location, extends substantially through the center of an operating site defined in or at the head of a patient stretched out on the patient rest or support structure. In this manner, it is rendered possible that, when rolling movements or motions with the patient rest or support structure are accomplished by means of a suitable drive for such rolling motion, the center of the operating site remains essentially unchanged at the same location. By virture of this arrangement of the rolling or roll axis, the expenditure for adjusting means and mechanisms for the rolling or pivotal movement of the patient rest or support structure is considerably reduced.

4 Claims, 2 Drawing Sheets

OPERATING TABLE

BACKGROUND OF THE INVENTION

The present invention broadly relates to surgical tables and, more specifically, pertains to a new and improved construction of operating table, particularly for microsurgery of the throat, nose or ears of a patient.

Generally speaking, the operating table of the present development is of the type in which the location of the operating site or field, during surgically required pitching and rolling movements of the patient rest or support structure, essentially remains locally unchanged, and which comprises a rolling or roll axis disposed within a vertical plane which is substantially parallel to the longitudinal direction of the patient rest or support structure.

An operating table of this type is known, for example, from European Pat. No. 0,086,881, published Aug. 31, 1983 and the cognate U.S. Pat. No. 4,558,857, granted Dec. 17, 1985. The supporting frame carrying the patient rest or support structure is supported at the longitudinal axis of the operating table by means of a parallelogram lever linkage arrangement. A drive or drive mechanism accomplishes by means of this parallelogram lever linkage arrangement the rolling motion or movements of the patient rest or support structure about the longitudinal axis of symmetry of the latter. By virtue of the parallelogram lever linkage arrangement or arrangements, the rolling or pivotal movements of the patient rest or support structure are carried out in such a manner that an operating punctiform location in the operating site or field of the patient, which operating punctiform location is essentially disposed within the longitudinal plane of symmetry, will remain unchanged in position. However, this parallelogram lever linkage arrangement is complicated and the manufacture of such constructions requires a corresponding constructional expenditure and is therefore generally uneconomical.

Parallelogram lever linkage arrangements of prior art operating-table constructions constitute a considerable share of the production costs of an operating table, especially since for static reasons such arrangements have to be provided in duplicate or as a pair. The relative large number of moving parts and components also has the disadvantage of a large number of flexible or articulated links or connections, so that a relatively high expenditure is already required for the production of a linkage mechanism which has to be substantially free from play. The total play increases with the working or operating time and, accordingly, the accuracy of motion and the stability decrease. It is readily conceivable what this can mean in the very special field of microsurgery.

SUMMARY OF THE INVENTION

Therefore, with the foregoing in mind, it is a primary object of the present invention to provide an improved construction of an operating table, particularly an operating table for microsurgery which does not suffer from the aforementioned economical drawbacks of the prior art constructions.

Another and more specific object of the present invention aims at providing a new and improved construction of an operating table, in particular an operating table for microsurgery which is constructed in such a manner that a considerably smaller constructional and production expenditure is necessary for the table mounting arrangement with respect to rolling or pivotal movements of the patient rest or support structure, and that the operating site or field is essentially not displaced during the aforesaid rolling or pivotal movements.

Now in order to implement these and still further objects of the invention, which will become more readily apparent as the description proceeds, the operating table of the present development is manifested, among other things, by the features that a rolling bearing of the operating table is inclined at a predetermined angle to the patient rest or support structure, and that the extended longitudinal axis of the rolling bearing of the operating table extends through or intersects a predetermined center or central point within the operating site or field in which a patient is positioned or accommodated, such predetermined center or central point being disposed in a substantially vertical plane.

According to a further feature of the operating table constructed as in the present invention, the rolling bearing of the operating table defines an angle with respect to the plane of the patient rest or support structure in such a manner that the extended longitudinal axis of the rolling bearing constitutes the rolling or roll axis and extends, subsequent to intersection thereof with the plane of the patient rest or support structure, substantially through the operating site or field in which the head of the patient is positioned on the patient rest or support structure.

Furthermore, the operating table constructed according to the invention advantageously comprises a supporting frame for the patient rest or support structure, an upright standard or column, and a box-type carrier supported by the upright standard or column by means of a suitable drive or drive mechanism for the elevational adjustment of a patient rest or support structure. The rolling bearing comprising a rolling pivot pin constitutes or defines the operating-table bearing and is mounted at the box-type carrier in such a manner that the supporting frame is rotatably mounted at the rolling bearing of the operating table.

Still a further feature of the new and improved operating table of the present development is characterized in that a further suitable drive or drive mechanism is provided for controlling the rolling movements of the patient rest or support structure. This drive or drive mechanism is connected by articulated or hingedly connected linkage means, at one end, to the supporting frame and, at the other end, to the box-type carrier.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various Figures of the drawings, there have been generally used the same reference characters to denote the same or analogous components and wherein.

DETAILED DESCRIPTION OF THE PREFERRED EMBODIMENTS

Figure 1:
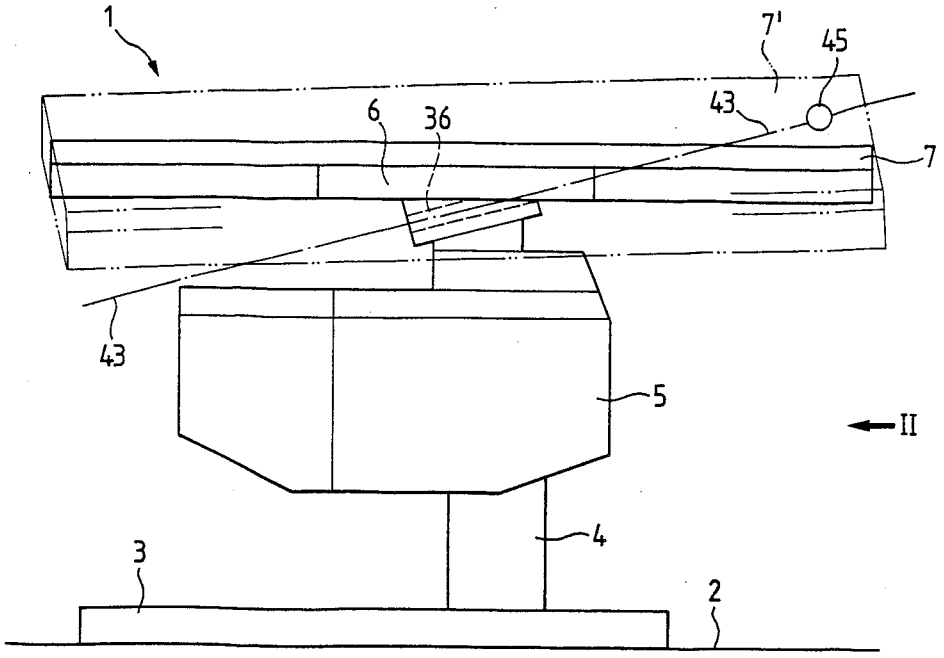
FIG. 1 is a schematic side view of the operating table constructed according to the invention.

Describing now the drawings, it is to be understood that in order to simplify the illustration thereof only enough of the construction of the operating table has been illustrated therein as is needed to enable one skilled in the art to readily understand the underlying principles and concepts of the present invention. Turning attention now specifically to FIGS. 1 and 2 of the drawings, which depict an exemplary embodiment of operating table 1 in side view and in end view, respectively, such operating table 1 illustrated therein by way of example and not limitation will be seen to essentially comprise an undercarriage 3 standing on and fastenable in any suitable manner to a floor or base 2, an upright standard or column 4 mounted thereat, and a box-type carrier 5 for a supporting frame 6 provided with a patient rest or support structure 7.

The patient rest or support structure 7 can encompass, if necessary, a headrest or head support member, a backrest or back support member, a seat or pelvis rest or support member, and a leg rest or leg support member. These individual rest or support members can be positionally adjustable with respect to one another. The upright standard or column 4 includes an apparatus or device for the elevational adjustment of the operating table 1. At the upper end of the upright standard or column 4 there is arranged an inclined or tilted pivot pin 36. The extended longitudinal axis of this inclined pivot pin 36 forms or constitutes a rolling or roll axis 43 and extends through an operating site or field or location 45. The patient rest or support structure 7 can be pivoted or rotated about the inclined pivot pin 36 by means of a suitable drive or drive mechanism 50 which is arranged between the upright standard or column 4 and the supporting frame 6.

Figure 3:
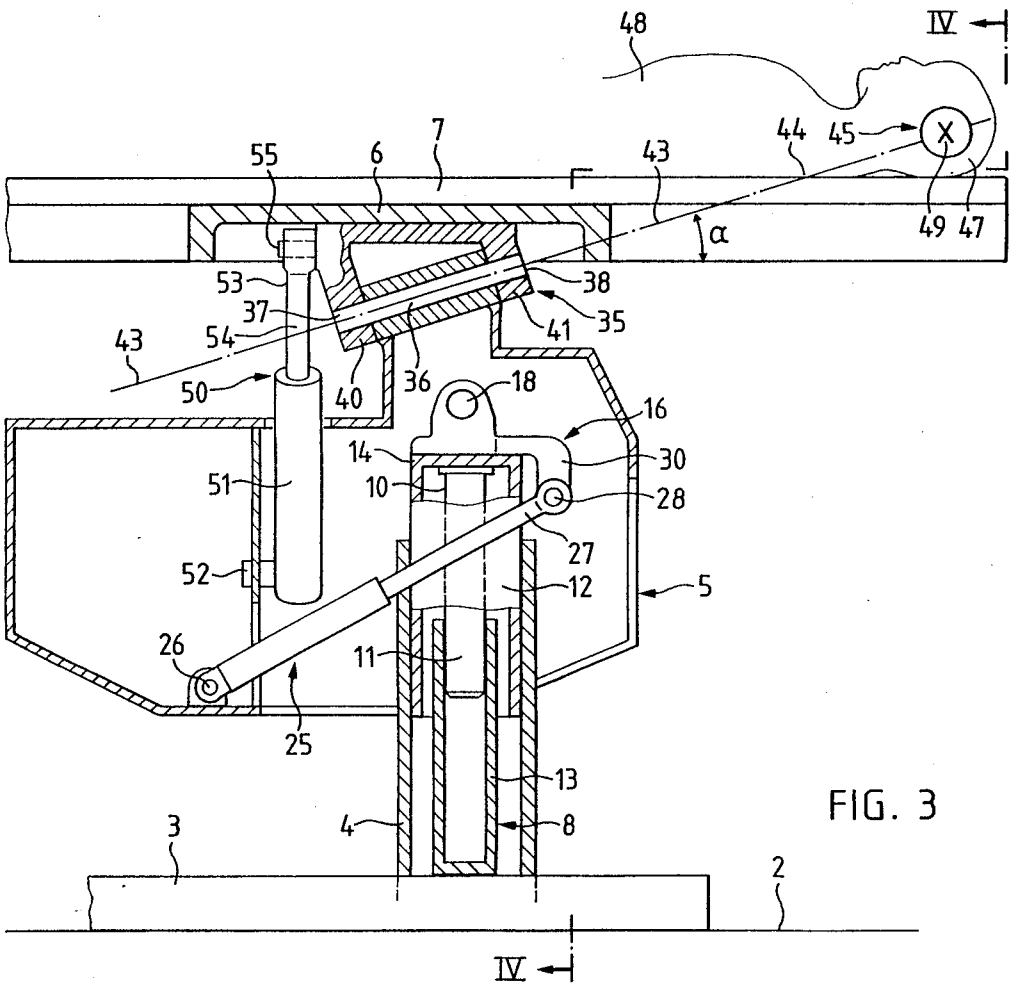
FIG. 3 is a longitudinal section taken substantially along the line III—III in FIG. 2, illustrating details of the operating table constructed according to the invention.

FIG. 3 shows details of the operating table 1 constructed according to the invention. In the upright standard or column 4 there is provided a suitable drive or drive means 8, for instance a hydraulic drive, for substantially vertical lifting and lowering movements of the patient rest or support structure 7. The free end 10 of a piston rod 11 of the drive or drive means 8, hereinafter conveniently referred to as the elevational drive 8, is mounted in a telescopic tube 12 which is guided in or telescoped into the upright standard or column 4. A cylinder 13 of the elevational drive 8 is appropriately secured at the undercarriage 3 of the operating table 1. At the free or upper end 14 of the telescopic tube 12 there is mounted a pitching or pitch bearing 16 in which a pitching pivot pin 18, which is transversely oriented relative to the patient rest or support structure 7, is rotatably mounted.

Figure 4:
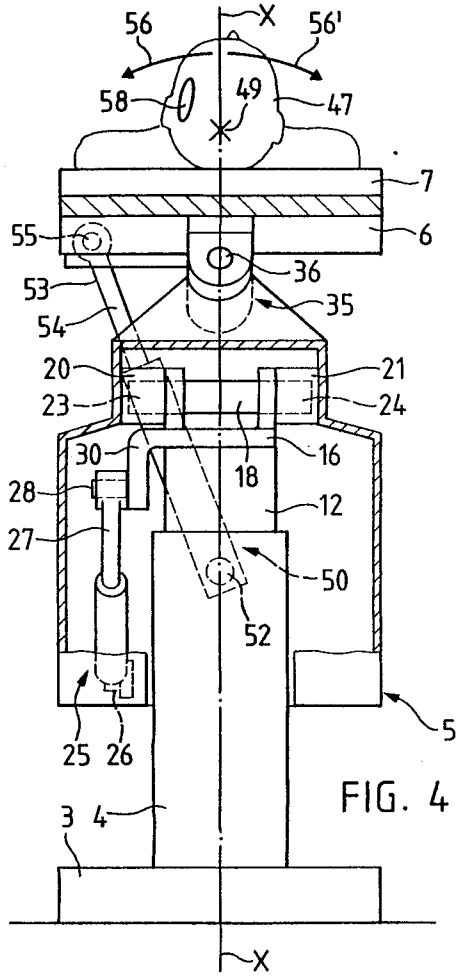
FIG. 4 is an end view, partially in section taken substantially along the line IV—IV in FIG. 3.

The box-type carrier 5 is supported by the pitching pivot pin 18 and is pivotable about the latter. The pitching pivot pin 18 is arranged essentially orthogonally or at right angles to the substantially vertical plane X—X, depicted in FIG. 4, and in which plane X—X the rolling or roll axis 43 is located. Furthermore, the box-type carrier 5 is provided with two bearings or bearing members 20 and 21 which are rotatable about the two free ends 23 and 24, respectively, of the pitching pivot pin 18, the two free ends 23 and 24 being arranged to project from the pitching or pitch bearing 16.

The pitching movements of the box-type carrier 5 together with the patient rest or support structure 7 are controlled by a suitable drive or drive mechanism 25, for instance a hydraulic drive. This drive or drive mechanism 25, hereinafter conveniently referred to as the pitching drive 25, is rotatable or pivotable about a pin 26 located at the box-type carrier 5, while the free end of the piston rod 27 of the pitching drive 25 is rotatable or pivotable about a pin 28 which is located at an arcuately bent-away member 30 of the pitching or pitch bearing 16.

The box-type carrier 5 is advantageously provided with a rolling or roll bearing 35, in which the inclined or tilted pivot pin 36 of the patient rest or support structure 7 is mounted. This pivot pin 36 is essentially located within the substantially vertical plane X—X which is parallel to the longitudinal direction of the patient rest or support structure 7. At the ends 37 and 38 of the inclined pivot pin 36 which project from the rolling or roll bearing 35, respective bearings or bearing members 40 and 41 of the patient rest or support structure 7 are rotatably mounted. The inclined pivot pin 36 defines with the plane of the patient rest or support structure 7 a predetermined angle $\alpha$ such that the extended longitudinal axis of this inclined pivot pin 36, in other words the rolling or roll axis 43, subsequent to intersection thereof with the plane of the patient rest or support structure 7 at a predetermined punctiform location 44, extends through the center or central point 49 of the operating site or field 45 which is located in or at the head 47 of a patient 48 stretched out and lying on his or her back on the patient rest or support structure 7.

In contrast with the known operating table disclosed in the hereinbefore mentioned European Pat. No. 0,086,881 and the cognate U.S. Pat. No. 4,558,857, the longitudinal axis of the rolling or roll bearing 35, i.e. the axis of the inclined pivot pin 36, coincides with the rolling or roll axis 43. This arrangement renders possible an essentially simpler construction and design of the mounting and drive or powering required for the rolling motion of the patient rest or support structure 7.

The rolling movements of the patient rest or support structure 7 about the inclined pivot pin 36 are controlled by the aforementioned drive or drive mechanism 50, for instance a hydraulic drive. A cylinder 51 of this drive or drive mechanism 50, hereinafter conveniently referred to as the rolling drive 50, is flexibly connected to a pin 52 provided at the box-type carrier 5. The free end 53 of a piston rod 54 is articulated with a pin 55 mounted at the supporting frame 6. Upon actuation of rolling drive 50, the patient rest or support structure 7 is rotated about the rolling or roll axis 43 in the directions of the arrows 56 and 56', respectively. Since the rolling or roll axis 43 extends through the center or central point 49 of the operating site or field 45 in or at the head 47 of the patient 48, the location of the head 47 of the patient 48 remains practically unchanged during rolling motion of the patient rest or support structure 7 with the patient 48 positioned thereupon. An operating location 58 of the patient 48, for example, the internal ear, describes only a small part or portion of a circular arc with the radius of the relatively small distance or spacing between the rolling or roll axis 43 and the internal ear. In this manner, the position of the operating or surgical microscope aligned at the operating location 58 need be only very slightly corrected by the surgeon without requiring any change in the working position of the latter.

In the case of pitching motion of the patient rest or support structure 7 about the pitching axis, i.e. the pitching pivot pin 18, the pitching drive 25 and the elevational drive 8 are controlled, in known manner, by means of opposite movements which, as it were, compensate one another. The piston rod 27 of the pitching drive 25 and the piston rod 11 of the elevational drive 8 are simultaneously actuated at a predetermined speed ratio, in order to compensate for the elevational change of the operating table 1 caused by the pitching rotation or pivot motion about the pitching pivot pin 18. In the case of simple rotation of the box-type carrier about the pitching pivot pin 18, the operating site or field 45 and thus the head 47 of the patient 48 are lifted or lowered. For this reason, the patient rest or support structure 7 during the pitching rotation is simultaneously lifted or lowered by the elevational drive 8 by an amount which compensates for the elevational difference or change, so that the operating site or field 45 and the head 47 of the patient 48 remain substantially unchanged at the same location. However, there will be recognized that this compensation leaves a residual error, because the rotational movement, analyzed in Cartesian manner, comprises two translational movements, for instance a vertical and a horizontal translation, while only one compensating translational movement, in this case the vertical translational movement, is actually carried out. The residual error constitutes the omitted translational movement, in this case the compensating horizontal translational movement. On the other hand, the horizontal translational movement is substantially smaller than the compensated vertical translational movement.

Figure 2:
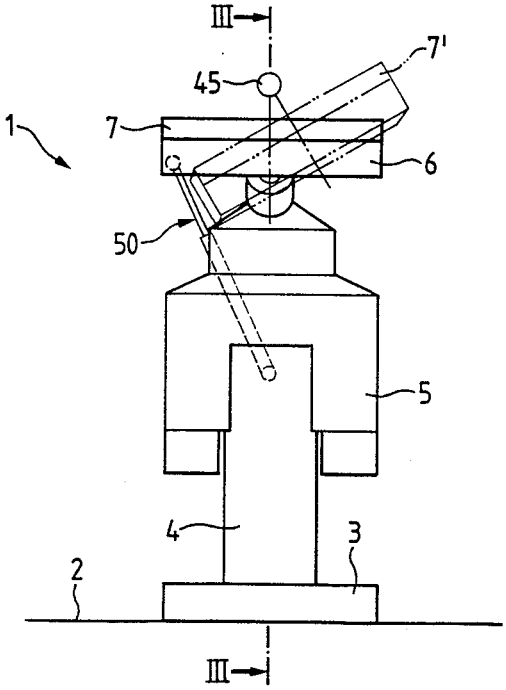
FIG. 2 is an end view, looking in the direction of the arrow II in FIG. 1, of the operating table depicted therein.

It is readily conceivable that even then, when a rolling movement of the patient rest or support structure 7 is carried out in combination with a pitching movement such that the patient rest or support structure 7 assumes a new position 7' as depicted in FIGS. 1 and 2, the position of the operating site or field 45 and the head 47 of the patient 48 is substantially preserved at the same location, i.e. allowing for a slight and therefore tolerable deviation.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An operating table, in particular for microsurgery of the throat, nose or ears of a patient, comprising:

means defining a rolling axis;

a patient rest structure;

said patient rest structure having a predetermined longitudinal direction;

said rolling axis being disposed essentially within a vertical plane which is substantially parallel to said predetermined longitudinal direction of the patient rest structure;

means for supporting said patient rest structure during rolling movements such that a surgical operating site remains essentially at the same location during said rolling movements;

said means defining said rolling axis including table rolling bearing means having a predetermined longitudinal axis;

said table rolling bearing means being inclined at a predetermined angle to said patient rest structure;

said predetermined longitudinal axis of said table rolling bearing means extending through a predetermined central point which is located in said surgical operating site and substantially disposed in said vertical plane; and means for supporting said patient rest structure during pitching movements such that said surgical operating site remains essentially at the same location during said pitching movements.

2. The operating table as defined in claim 1, wherein:

said predetermined angle defined by said table rolling bearing means with said patient rest structure being selected such that said predetermined longitudinal axis of said table rolling bearing means constitutes said rolling axis and, subsequent to intersecting said patient rest structure, extends through said surgical operating site in which the head of a patient stretched out on said patient rest structure is positioned.

3. The operating table as defined in claim 2, further including:

a supporting frame for said patient rest structure;

an upright standard;

drive means for the elevational adjustment of said patient rest structure;

a substantially box-type carrier supported by said upright standard by means of said drive means;

said table rolling bearing means comprising a rolling bearing provided with a pivot pin; and said rolling bearing provided with said pivot pin being mounted at said substantially box-type carrier in such a manner that said supporting frame is rotatably mounted at said table rolling bearing means.

4. The operating table as defined in claim 3, wherein:

said means defining said rolling axis include drive means having oppositely located ends for controlling said rolling movements of said patient rest structure;

hingedly connected linkage means; and said drive means for controlling said rolling movements being connected by said hingedly connected linkage means, at one end, to said supporting frame and, at the other end, to said substantially box-type carrier.

* * * * *